US005369932A

United States Patent [19]

Passero

[11] Patent Number: 5,369,932

[45] Date of Patent: Dec. 6, 1994

[54] DEVICE FOR STACKING FLAT ARTICLES TO FORM ONE OR MORE STACKS INTO A BOX-SHAPED CONTAINER

[75] Inventor: Adolfo Passero, Caserta, Italy

[73] Assignee: Alcatel Italia S.p.A., Milan, Italy

[21] Appl. No.: 32,051

[22] Filed: Mar. 16, 1993

[30] Foreign Application Priority Data

May 28, 1992 [IT] Italy ..... MI92A001309

[51] Int. Cl.[5] ..... B65B 5/10; B65B 39/06

[52] U.S. Cl. ..... 53/260; 53/248

[58] Field of Search ..... 53/260, 255, 244, 540, 53/475, 248, 235, 534

[56] References Cited

U.S. PATENT DOCUMENTS

| | | | |
|---|---|---|---|
| 3,541,758 | 11/1970 | Welborn | 53/255 X |
| 3,888,363 | 6/1975 | Erekson | 271/213 X |
| 3,937,456 | 2/1976 | Gruodis et al. | 271/64 |
| 4,608,808 | 9/1986 | Ryan et al. | 53/248 X |
| 5,170,610 | 12/1992 | Tisma | 53/260 X |
| 5,263,300 | 11/1993 | Plent et al. | 53/255 X |

FOREIGN PATENT DOCUMENTS

| | | |
|---|---|---|
| 2388721 | 11/1978 | France . |
| 1924949 | 8/1970 | Germany . |
| 3634776 | 4/1988 | Germany . |

*Primary Examiner*—James F. Coan

*Attorney, Agent, or Firm*—Spencer, Frank & Schneider

[57] ABSTRACT

A device for stacking flat articles, advancing from an outlet of a conveyor system or the like, to form one or more stacks into a box-shaped container. The stacking device includes a supporting plane member for supporting articles arranged above a container and movable rapidly and horizontally between a rest position, in which the supporting plane member covers the top opening of the container, to a discharge position, in which the opening is left uncovered. An actuator rapidly moves the supporting plane member. A supporting frame is arranged over the supporting plane member, and at least one inclined chute is fixed to the supporting frame having a lower end on the supporting plane member parallel to the direction of motion of the supporting plane member. The at least one chute receives articles advancing from an outlet and transfers them by gravity to the supporting plane member with a predetermined orientation.

7 Claims, 3 Drawing Sheets

DEVICE FOR STACKING FLAT ARTICLES TO FORM ONE OR MORE STACKS INTO A BOX-SHAPED CONTAINER

BACKGROUND OF THE INVENTION

1. Field of the Invention

The present invention relates to a device for stacking flat articles to form one or more stacks into a box-shaped container.

2. Background Information

At the present time there are known several kinds of stackers designed to stack various flat articles, such as books, cassettes, records and the like, coming from a standard transport system or a sorting machine, into box-shaped containers.

These stackers can be used in a many fields, e.g., they can be used for forming packages in the field of publishing, food-stuffs packaging, postal services, and the like.

One of these known kinds of stackers is disclosed, e.g., in U.S. Pat. No. 3,937,456 (Gruodis et al.). It comprises a movable article transporter, inclined slides located beneath the transporter, and containers having three sides and an open top, located at the lower end of the slides.

The containers are mounted on respective sensor controlled elevators for adjusting the height of the containers in accordance with the height of the stack detected by the sensors.

When a container is full, it is replaced with an empty one.

The containers have an inclined interior floor surface and are of a very complicated structure. Moreover, when one or more stacks of articles are to be formed within a package, it is necessary to remove manually the finished stacks from the containers and place them in the package, which represents an additional cost. Further, the stacker as a whole is somewhat complicated and expensive.

In U.S. Pat. No. 3,888,363 (Erekson) there is disclosed an indexing stacker for flat objects. It is composed of four compartments and the articles are delivered to each compartment by conveying means. When a stack of a predetermined number of articles is formed in the compartment, the stacker is indexed 90 degrees and an empty compartment faces the output of the conveyor in order to be filled. When all the four compartments are filled with the required number of articles, the finished stacks are removed, either manually or through automated means, and placed in a box.

Thus, this type of stacker involves an additional operation and therefore an additional cost. Moreover, this device is somewhat complicated and expensive, too.

Other stacking devices are based upon modules having a bottom surface which is opened like a hinged trapdoor over the container allowing the carried article to be dropped into the container. However, these devices, besides requiring a complicated mechanism for opening and closing the bottom whereby they are subjected to jamming, require a certain spacing between the container and the trapdoor in order to permit the downwards opening of the latter, and, because of the long trajectory of the falling articles, the resulting stacking is not very tidy.

SUMMARY OF THE INVENTION

The task of the present invention is to overcome the drawbacks of the prior art stacking devices by providing a device for stacking flat objects to form one or more stacks into a box-shaped container which, besides allowing a tidy stacking, is at the same time simple and inexpensive.

Within said task, it is an object of the present invention to provide a flat article stacking device of the type mentioned at the outset which is passive in nature and requires a lower number of moving parts with respect to prior art similar devices.

It is a further object of the invention to provide a flat article stacking device that further reduces the impact velocity of the article which is to be stacked with respect to prior art similar devices.

These and other objects, which will become apparent hereinafter, are achieved by a flat article stacking device according to the present invention having a supporting plane arranged above a container movable rapidly and horizontally from a rest position to a discharge position by actuating means, a supporting frame arranged over the supporting plane, and at least one inclined chute.

The basic idea is to lay down the articles, which are to be stacked into a container, on a supporting plane subdivided into as many parts as the underlying stacks to be formed in the container are, and to take away the support so quickly as to leave the articles in their rest position from which they drop by gravity into the underlying container, thus maintaining their orientation.

Thanks to this solution, a simple and inexpensive flat article stacking device is achieved which does not use complicated mechanisms for opening and closing hinged bottom walls and/or to rotate the container.

BRIEF DESCRIPTION OF THE DRAWINGS

Further characteristics and advantages of the invention will be more apparent from the following description of an embodiment thereof made with reference to the drawings attached as an indicative and not limiting example wherein.

DETAILED DESCRIPTION OF THE PREFERRED EMBODIMENTS

Figure 1:
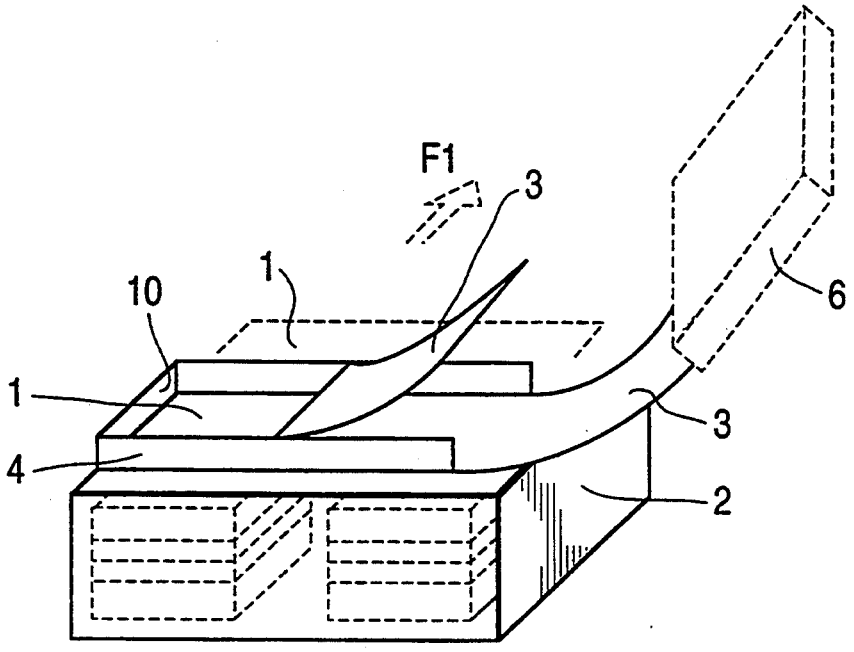
FIG. 1 is a schematic representation in a perspective view of the stacking device according to the present invention.
Figure 2:
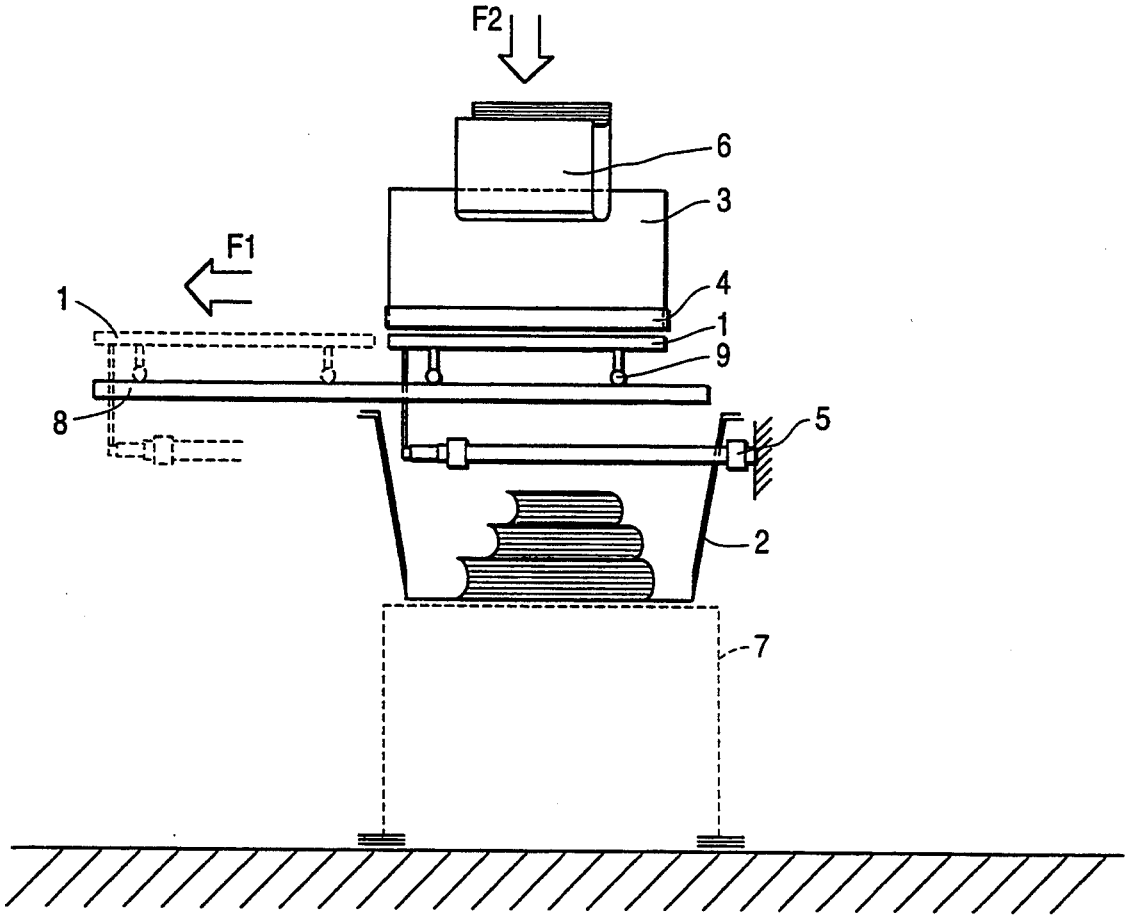
FIG. 2 is a front elevation schematic view of the device of FIG. 1.

Referring now to FIGS. 1 and 2, the stacker according to the invention is composed of a low-friction plate-shaped member 1 providing the supporting plane and disposed above the top opening of a box-shaped container 2 inside which flat articles 6 are to be stacked, and which is supported on a base 7. The plate-shaped member 1 is provided with wheels 9 rolling on horizontal guides 8 and is horizontally movable (in the direction indicated by arrow F1) from a rest position, where the plate-shaped member 1 practically covers the opening of container 2, to a discharge position (indicated by dashed line in FIG. 2) where said opening is left uncovered by member 1, and back to the rest position.

Member 1 is moved by actuator cylinder 5 having an end connected thereto, the other end of cylinder 5 being fixedly connected to the support structure (not shown) of the stacker itself.

Arranged above the plate-shaped member 1 is a supporting frame 4 fixed to the supporting structure and having a substantially rectangular shape (see FIG. 1) on which there are one or more inclined chutes 3 (one for each stack to be formed) whose lower ends are on the plate-shaped member 1, said lower ends being parallel to the direction of motion indicated by arrow F1.

The stacking device according to the invention operates as follows.

The plate-shaped member 1 forms a supporting plane for the articles 6 which are delivered by the conveyor or sorting apparatus selectively to each chute 3 upon command of an electronic control system of the conveying or sorting system (not shown) which the stacker is associated with.

Articles 6 slide on chutes 3 and stop on the supporting plane member 1 with a prefixed orientation in a position corresponding to the underlying stack in the container 2. The rim 10 and each of subsequent chutes 3 constitute a stop ledge for correctly positioning the articles on the supporting surface.

Upon command of conventional means connected with said electronic control system, the actuator cylinder 5 moves the plate-shaped member 1 very quickly to the discharge position. Because of this very rapid motion, the articles 6 maintain their rest position by inertia and, being no longer supported on the supporting plane 1 are dropped into the underlying container 2 thus maintaining their orientation.

The plate-shaped member 1 is then restored to its rest position before next article 6 is delivered by the conveyor or sorter.

Figure 4:
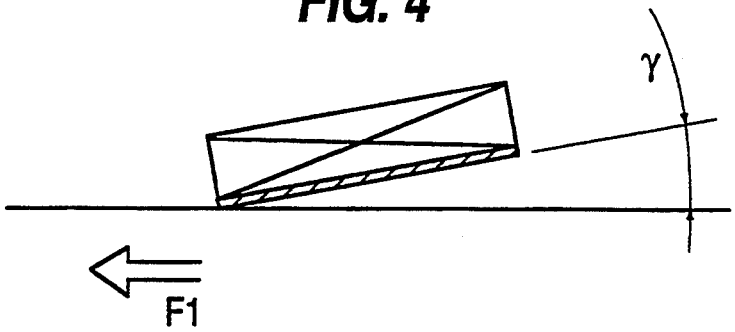
FIGS. 4 and 5 show details of the devices illustrated in FIGS. 2 and 3 respectively.

To advantage, in order to improve the attitude of the articles 6 during the fall, the supporting plane 1 is slightly inclined at an angle alpha (see FIG. 4) downwards in the direction of its displacement to the discharge position.

Figure 3:
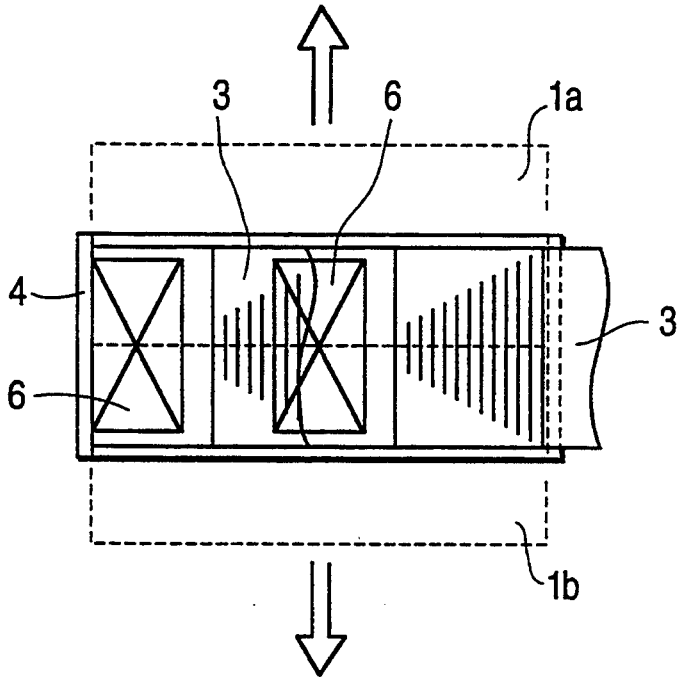
FIG. 3 shows another advantageous embodiment of the stacking device according to the present invention in a top plan view.
Figure 5:
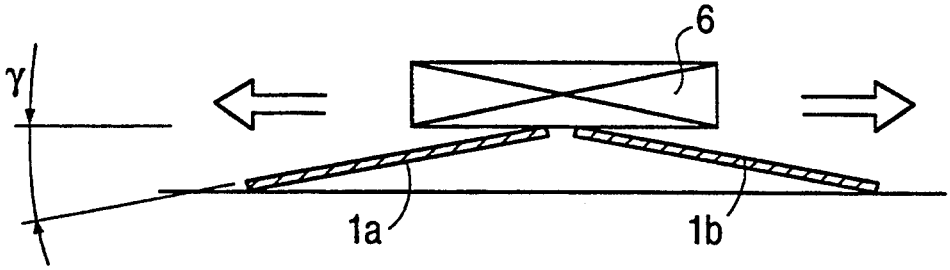

In a further, advantageous, embodiment of the stacker according to the present invention, illustrated in FIGS. 3 and 5, the supporting plane 1 is formed by two adjacent plate-shaped members 1*a*, 1*b*, joining along one side when in the rest position, which side is perpendicular to the directions of displacement. The two members 1*a*, 1*b*, are movable in opposite directions with respect to said joining side by respective actuator means, like that (5) shown in FIG. 2, connected therewith.

Such arrangement has the advantage of requiring a velocity of translation reduced to one half with respect to the one required by the arrangement of FIG. 2.

Also in this case, in order to improve the attitude of the falling articles, the two members 1*a*, 1*b*, are slightly inclined as shown in FIG. 5.

Thus, the stacking device according to the present invention fully achieves all the above-mentioned objects.

In fact, it is very simple in costruction, inexpensive to manufacture and with very few moving parts as compared with similar devices in the prior art.

Moreover, the height of fall, and therefore the terminal speed of the articles, is reduced, whereby the risk of damage to delicate articles is decreased. The attitude of the articles is maintained thus obtaining a tidy stacking within the container.

A further advantage is that, with the stacker according to the invention, it is possible to thereby stack at the same time a plurality of articles, to form a corresponding plurality of stacks in the container, thus reducing the stacking time.

Naturally numerous modifications and structural changes may be made without departing in any way from the spirit of the scope of the invention.

For instance, in order to further reduce the fall height of the articles 6, the underlying wheels 9 can be replaced with idle rollers pivoted directly at the sides of the plate-shaped element 1 while suitably adapting the guides 8, of course.

Further, the rapid motion of translation can be realized through any suitable equivalent means.

Finally, materials and dimensions can be adapted to the circumstances and requirements of use.

I claim:

1. A device for stacking flat and rigid articles, advancing from an outlet of a conveyor system, to form one or more stacks into a box-shaped container, said stacking device comprising:

a supporting plane member for supporting flat and rigid articles arranged above a container and movable rapidly and horizontally between a rest position, in which the supporting plane member covers the top opening of the container, to a discharge position, in which the opening is left uncovered so that the flat and rigid articles fall can vertically into the container;

actuating means for rapidly moving said supporting plane member;

a supporting frame arranged over said supporting plane member, and at least one stationary inclined chute fixed to said supporting frame having a lower end on said supporting plane member parallel to the direction of motion of said supporting plane member, said at least one stationary inclined chute for receiving flat and rigid articles advancing from an outlet and transferring them by gravity to said supporting plane member with a predetermined orientation, said at least one stationary inclined chute transferring the flat and rigid articles onto said supporting plane member with a continuous motion and without rotation.

2. The device for stacking flat and rigid articles according to claim 1, wherein said supporting plane member is formed by a plate-shaped member sliding with rolling friction on two fixed guides arranged parallelly to said direction of motion.

3. The device for stacking flat and rigid articles according to claim 2, wherein said plate-shaped member is inclined downwards relative to motion towards the discharge position.

4. The device for stacking flat and rigid articles according to claim 1, wherein said actuating means comprises at least one actuator cylinder having an end connected with said plate-shaped member.

5. The device for stacking flat and rigid articles according to claim 1, wherein said supporting plane member is formed by two adjacent plate-shaped members joining along one side when in said rest position, said joining side being perpendicular to said direction of motion, said two plate-shaped members being movable in opposite directions with respect to said joining side.

6. The device for stacking flat and rigid articles according to claim 5, wherein said two adjacent plate-shaped members are each inclined downwards relative to their respective motion towards said discharge position.

7. The device for stacking flat and rigid articles according to claim 5, wherein said actuating means comprises at least one actuator cylinder acting on each of said plate-shaped members.

* * * * *